US006822177B1

(12) United States Patent
LaPlante

(10) Patent No.: US 6,822,177 B1
(45) Date of Patent: Nov. 23, 2004

(54) SWITCH ACTUATOR

(76) Inventor: Grant W. LaPlante, 1006 Square Ter., Green Bay, WI (US) 54313

( * ) Notice: Subject to any disclaimer, the term of this patent is extended or adjusted under 35 U.S.C. 154(b) by 0 days.

(21) Appl. No.: 10/655,157

(22) Filed: Sep. 4, 2003

Related U.S. Application Data

(60) Provisional application No. 60/473,112, filed on May 23, 2003.

(51) Int. Cl.[7] ..... H01H 3/20
(52) U.S. Cl. ..... 200/331
(58) Field of Search ..... 200/329, 330, 200/331, 332; 74/544

(56) References Cited

U.S. PATENT DOCUMENTS

| | | | |
|---|---|---|---|
| 2,389,220 | A | 11/1945 | Tredeau |
| 2,692,932 | A | 10/1954 | Parke et al. |
| 2,724,032 | A | 11/1955 | Coletta |
| 2,726,303 | A | 12/1955 | Berndsen |
| 3,004,128 | A | 10/1961 | Mikolajeski |
| 3,077,789 | A | 2/1963 | De Lashmutt |
| 3,121,778 | A | 2/1964 | Sander et al. |
| 3,142,744 | A | 7/1964 | Keck |
| 3,175,420 | A | 3/1965 | Craig |
| 3,188,439 | A | 6/1965 | Fullerton |
| 3,339,051 | A | 8/1967 | De Vall |
| 3,581,037 | A | 5/1971 | Schiffelbein |
| 3,722,319 | A | 3/1973 | Reznik et al. |
| 3,839,615 | A | 10/1974 | Bradford |
| 3,892,935 | A | 7/1975 | Patterson |
| 3,916,134 | A | 10/1975 | Hansen |
| 4,256,943 | A | 3/1981 | Whitlock |
| 4,295,026 | A | 10/1981 | Williams et al. |
| 4,419,556 | A | 12/1983 | Hare |
| 4,454,401 | A | 6/1984 | Powis, Jr. |
| D274,972 | S | 8/1984 | Mann, Jr. |
| 4,567,337 | A | 1/1986 | Woods, I et al. |
| 4,705,924 | A | 11/1987 | Hevoyan |
| 4,870,232 | A | 9/1989 | Hoogland |
| 5,017,746 | A | 5/1991 | Guimarin |
| 5,046,143 | A | 9/1991 | Uher |
| D326,445 | S | 5/1992 | Enyeart |
| D328,285 | S | 7/1992 | Giles |
| D334,563 | S | 4/1993 | Burbage |
| D335,121 | S | 4/1993 | Brillheart, III |
| D345,681 | S | 4/1994 | Bruzzi |
| D352,277 | S | 11/1994 | Olsen |
| 5,380,967 | A | 1/1995 | Steen et al. |
| D355,643 | S | 2/1995 | Warnock et al. |
| 5,393,946 | A | 2/1995 | DeLaHoz |
| 5,396,037 | A | 3/1995 | Moore et al. |
| 5,498,845 | A | 3/1996 | Browning |
| D381,636 | S | 7/1997 | Bush |
| 5,782,342 | A | 7/1998 | Hewitt et al. |
| 5,875,886 | A | 3/1999 | Elster |
| D429,222 | S | 8/2000 | Phillips et al. |

*Primary Examiner*—James R. Scott
(74) *Attorney, Agent, or Firm*—Wilhelm Law Service; Eric J. Lalor; Thomas D. Wilhelm

(57) ABSTRACT

A switch actuator comprising a housing which resiliently and frictionally engages the toggle of a switch. The housing can optionally include an outer flange and/or a generally rigid elongate arm extending from the housing. The actuator, typically through use of the outer flange and/or the arm, can be manipulated so as to correspondingly manipulate a wall switch.

29 Claims, 5 Drawing Sheets

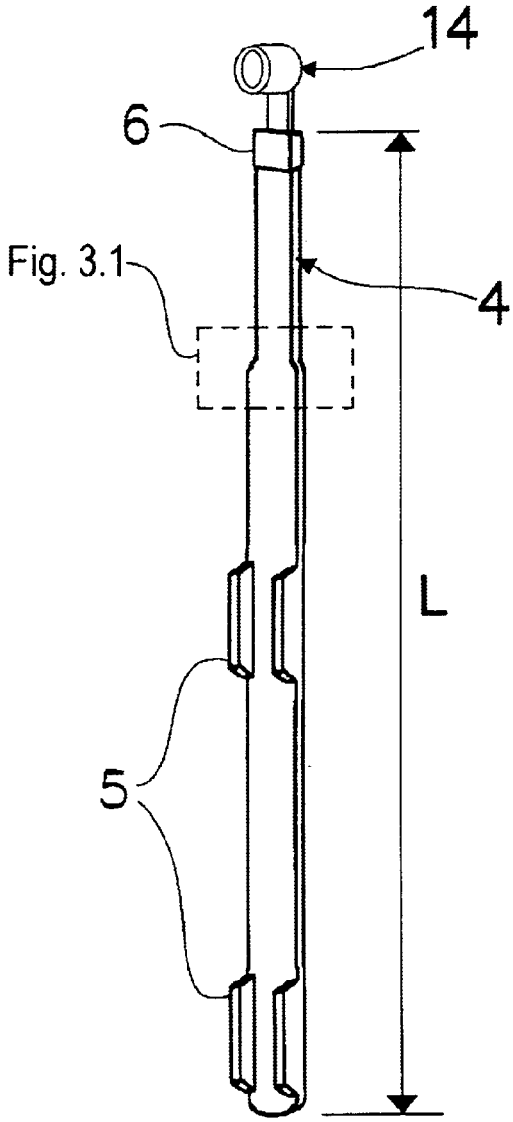
Fig. 3
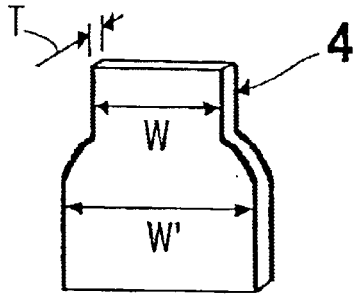
Fig. 3.1

SWITCH ACTUATOR

BACKGROUND

The present invention relates to the process of operating wall switches, specifically toggle-type wall switches, which have typically up and down positions for closing and opening an electrical circuit. The invention relates especially to accessing and manipulation of such switches by users who have difficulty accessing and manipulating such switches. For example, the present invention is especially beneficial for use by children or other persons with impaired or incompletely developed motor functions and or motor skills.

Typically, wall switches are located on a wall, at a standard height relative to the corresponding floor. The standard height of wall switches may vary according to geographic location, as dictated by local standards in the building trades, variation in local building code requirements and/or other social considerations. However, considering the range of specifications in local requirements and social considerations from community to community, wall switches are typically installed at a height approximately forty to forty-five inches, as measured from a finished floor to the bottom of a wall switch-box.

Such height positions such wall switches out of the reach of small children, and typically at a difficult or impossible to reach location for wheel chair patients. In the case of children, a child who fails to reach a wall switch without assistance may subsequently attempt to reach such switch by standing on an object, such as a chair or stool, to gain enough height to reach the switch. However, finding and standing on an object to operate the switch can prove frustrating, or dangerous to the child.

In the case of persons in wheel chairs, if the switch is beyond their reach, such persons typically have no credible option for reaching and manipulating the switch, short of accessing the assistance of an ambulatory person. In too may instances, such assistance by an ambulatory person is not available whereby the need to use the switch is ultimately unfulfilled.

It is thus an object of the invention to provide a switch actuator comprising an actuator housing which resiliently deflects to conform to a switch toggle, thus to receive and grip the switch toggle as the actuator is pushed into engagement, onto and around the switch toggle, thereby to make the switch more accessible and more easily accessed and manipulated.

It is another object to provide a switch actuator which comprises a generally rigid elongate arm extending typically downwardly from the actuator housing.

Such switch actuator enables those who would otherwise experience difficulty operating a wall switch, mounted at a typical height, to operate such switch. This invention reduces the amount of dexterity required, and reduces the magnitude of vertical access required to effectively manipulate a wall switch. The aforementioned advantages are accomplished by extension and control features of the invention. Such extension and control features optionally include an outer flange or other enlargement feature having a diameter larger than a toggle of the switch, optionally larger than a canister of the housing which goes over the switch, optionally extending along the longitudinal axis of the housing and away from the switch-facing end and comprising any desired shape, and a generally rigid elongate arm which can extend downwardly from a toggle of a switch. The arm can extend in a straight line, or can be fabricated in a wide variety of configurations so as to facilitate gripping manipulation by users having impaired or relatively lesser developed gripping capacity.

Other benefits and advantages of the novel switch actuator of the invention will be apparent from the following description and accompanying drawings.

SUMMARY

This invention is directed toward improved switch actuators. More specifically, this invention provides improved switch actuators adapted for use with wall mounted toggle switches. A typical switch actuator includes a switch actuator housing, which comprises a canister having a relatively more flexible switch-facing end, and a relatively less flexible user-facing end. A flange and/or a resiliently flexible neck optionally extends downwardly from the canister. A generally rigid arm optionally extends from the switch actuator housing. Either the arm or the housing, or both, can comprise mounting structure adapted to receive one or more display items.

In a first family of embodiments, the invention comprehends a switch actuator comprising a generally flexible actuator housing having a longitudinal axis, and a generally rigid arm extending from the actuator housing. The generally flexible actuator housing comprises a canister having an outer surface, a left side and a right side, and a width W2 between the left and right sides. The canister further comprises a resiliently flexible switch-facing end and a generally closed and relatively less flexible user-facing end. The generally flexible switch-facing end has an opening adapted to resiliently flex and to thereby receive and grip a switch toggle. The switch actuator further comprises a generally flexible neck extending from the canister, the flexible neck having a width W3, the magnitude of width W2 of the canister being greater than magnitude of width W3 of the generally flexible neck. The arm extends preferably as an elongate arm from the generally flexible neck, away from the canister, optionally through a shoulder.

In some embodiments, the actuator housing further comprises a shoulder extending from the neck and away from the canister, the shoulder being located proximate and typically being mounted to, the generally rigid arm, the shoulder having a width W4, the magnitude of each of width W4 and width W2 being greater than the magnitude of width W3 of the neck.

In some embodiments, the arm has a first distal end and a second distal end, and a length "L" therebetween, and the actuator housing further comprises a shoulder extending from the neck, the neck having a relatively smaller cross-section than the shoulder, and over half of an area defined by a length and a width of the shoulder communicating with one of the first and second distal ends of the arm.

In some embodiments, the arm has a front surface and a back surface, defining a thickness "T" therebetween, and first and second side edges having a width "W" therebetween, magnitude of width "W" being greater than magnitude of thickness "T".

In preferred embodiments, when the neck is free from stresses which deflect the neck from a rest condition, the generally flexible neck is generally coplanar with the arm.

In yet other embodiments, at least one of the arm and the canister further comprises mounting structure adapted to receive a display item.

In some embodiments, at least one of the arm and the canister is releasably impregnated with antibacterial material.

In a second family of embodiments, the invention contemplates a switch actuator, adapted to receive a switch, comprising an actuator housing having a longitudinal axis, and a generally rigid arm extending from the actuator housing. The housing comprises a canister having an outer surface, a left side and a right side, and a width W2 between the left and right sides, a resiliently flexible switch-facing end and a user-facing end, the resiliently flexible switch-facing end having an opening adapted to resiliently receive and grip a switch; a neck extending from the canister, the neck having a width W3, magnitude of the width W2 of the canister being greater than magnitude of the width W3 of the neck; and a flange extending outwardly from the outer surface of the canister and extending away from the longitudinal axis, the flange being displaced from the switch-facing end of the canister. The arm extends from the neck, outwardly extending away from the canister, optionally through a shoulder.

In some embodiments, the outwardly extending flange comprises at least one aperture extending therethrough.

In a third family of embodiments, the invention comprehends a switch actuator adapted to receive a switch. The actuator comprises a canister having an outer side surface, the canister further comprising a resiliently flexible switch-facing end and a user-facing end, the resiliently flexible switch-facing end having an opening adapted to resiliently receive and grip a switch; and a flange extending outwardly beyond the outer side surface of the canister and extending away from the longitudinal axis, and optionally in a 3-dimensional configuration along the longitudinal axis, the flange being displaced from the switch-facing end of the canister.

In some embodiments, the flange has at least one aperture extending therethrough.

In some embodiments, the flange has an outer perimeter, the at least one aperture being generally adjacent the outer perimeter of the outer flange, and optionally extending generally parallel to the longitudinal axis.

In some embodiments, the canister further comprises mounting structure adapted to receive a display item.

In a fourth family of embodiments, the invention comprehends a switch actuator adapted to receive a switch. The switch actuator comprises a generally flexible actuator housing having a longitudinal axis, and a generally rigid elongate arm. The actuator housing comprises a canister having a resiliently flexible switch-facing end and a user-facing end, the resiliently flexible switch-facing end having an opening adapted to resiliently receive and grip a switch; and a generally flexible neck extending, when the neck is free from stresses which would tend to deflect the neck from a rest condition, from the canister at an angle of about 45 degrees to about 150 degrees with respect to the longitudinal axis. The arm extends from the generally flexible neck, optionally through a shoulder and away from the canister.

BRIEF DESCRIPTION OF THE DRAWINGS

FIG. 3 shows a perspective view of the switch actuator of FIG. 2 from a second direction.

FIG. 3.1 shows an enlarged section of a portion of the switch actuator of FIG. 3, taken at 3.1 of FIG. 3.

Figure 1:
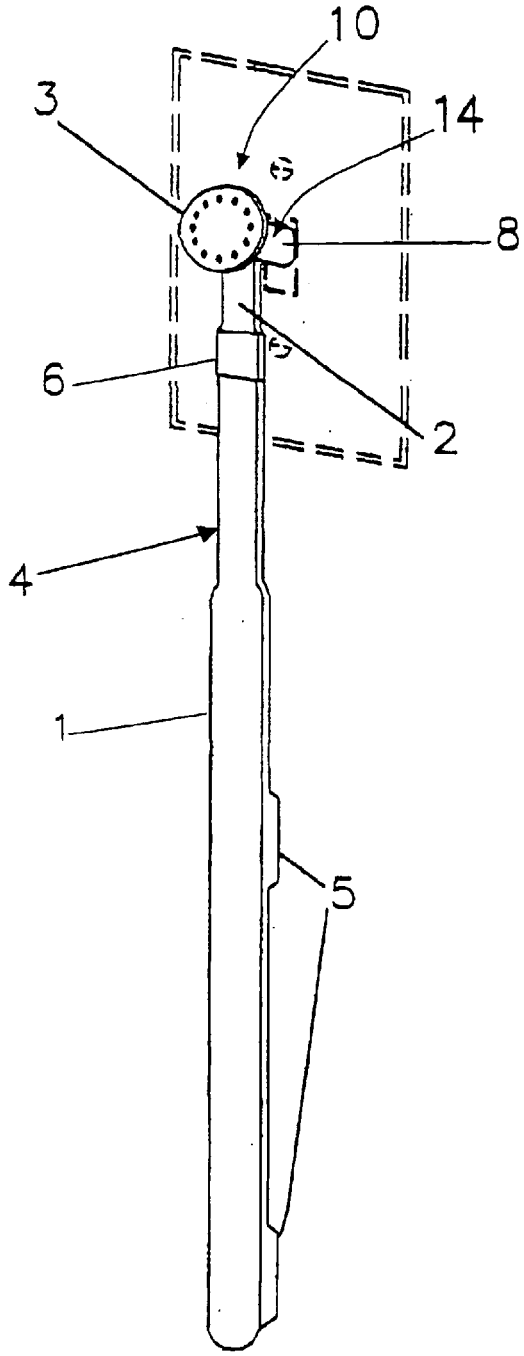
FIG. 1 shows a perspective view of a first embodiment of switch actuators of the invention, mounted to a switch.

The invention is not limited in its application to the details of construction or the arrangement of the components set forth in the following description or illustrated in the drawings. The invention is capable of other embodiments or of being practiced or carried out in other various ways. Also, it is to be understood that the terminology and phraseology employed herein is for purpose of description and illustration and should not be regarded as limiting. Like reference numerals are used to indicate like components.

DESCRIPTION OF THE ILLUSTRATED EMBODIMENTS

Referring now to the drawings, FIG. 1 shows a first embodiment of switch actuators 10 of the invention. Switch actuator 10 includes a housing 14, and an elongate handle 4 extending in a downward direction from housing 14. Housing 14 comprises a generally flexible canister 8, a neck 2 extending down from at or proximate a generally closed user-facing end of the canister, a shoulder 6 extending down from neck 2, and a flange 3 extending outwardly beyond the outer surface of canister 8 and away from a longitudinal axis "LA" (shown in FIG. 6) of housing 14. In some embodiments, as in e.g. FIG. 7, a plurality of apertures 9 extend through flange 3 and generally parallel to the longitudinal axis.

Figure 6:
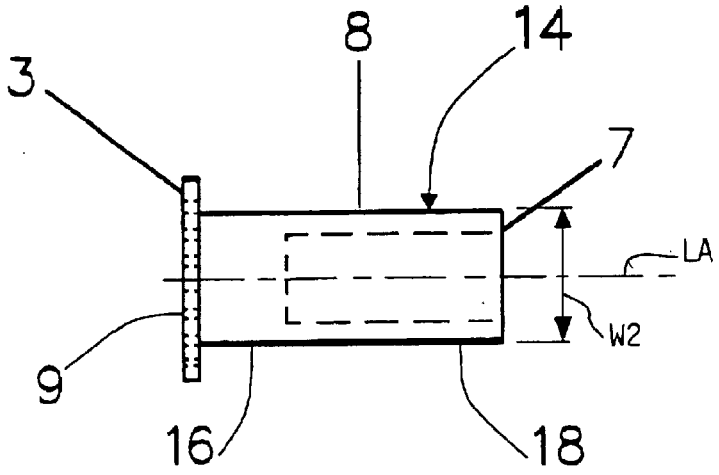
FIG. 6 shows is a top view of the switch actuator of FIG. 5.

As shown in FIG. 6, canister 8 extends from a user-facing end 16 to a switch-facing end 18, and has a width "W2" between the left side of the canister and the right side of the canister.

The portion of canister 8 which is disposed toward the user-facing end is preferably solid-core construction so as to enhance the bending resistance of the user-facing end of canister 8. By contrast, the portion of canister 8 which is disposed toward switch-facing end 18 defines an opening 7 which extends from the extremity of the switch-facing end toward the user-facing end of the canister.

Accordingly, the thickness of the material at the switch-facing end, between the outer surface of the canister and the inner surface of the canister at opening 7, is thinner than the material at the user-facing end. Given proper material selection, given the relative thicknesses of the material at the user-facing end and the switch-facing end, the resilient flexibility of the canister at the switch-facing end is substantially greater than the resilient flexibility of the canister at the user-facing end. The material and thicknesses are selected such that the material at the switch-facing end can resiliently deform about the toggle of an e.g. rectangular or square cross-section switch toggle as the canister is pushed onto the switch toggle, whereby the canister material about the opening 7 deforms about the switch toggle in order to extend over, and resiliently grip, the switch toggle.

By contrast, the material adjacent the user-facing end of the canister must be sufficiently resistant to bending to transfer an upwardly-directed or downwardly-directed motion of e.g. arm 4 into the arcuate motion of the switch toggle. Accordingly, the user-facing end of the canister is typically a closed end, with no holes extending therethrough, such that canister material which spans across the perimeter of the canister, from the longitudinal axis "LA" contributes substantially to such bending resistance, relative to the structure at the switch-facing end.

Flange 3 is shown extending outwardly from canister 8 at the user-facing end of the canister and extending a short distance from the user-facing end of the canister toward the switch-facing end of the canister. Thus, the user-facing surface of actuator 10 at housing 14 is represented in part by the user-facing end of the housing and in part by the user-facing side of flange 3, namely that portion of the user-facing end of the actuator which extends outwardly of the outer perimeter of canister 8. An apertures 9 are, correspondingly, disposed outwardly of the side surface of the canister, as well as away from longitudinal axis "LA" relative to the outer surface of the canister, and extend, as shown generally parallel the longitudinal axis "LA". An aperture 9 can extend at any desired angle through flange 3. The number of apertures can be specified over a wide range.

The purpose of flange 3 can be primarily utilitarian, to assist a user in gripping the switch toggle. In the alternative, flange 3 can be both utilitarian and decorative. For example, aperture 9 or the structure of flange 3 can be used as mounting structure, or attachment structure, for attaching or mounting one or more display items. As on option, flange 3 can be configured with any e.g. three-dimensional configuration desired, whereby such three-dimensional configuration can be e.g. a helmet, a football, a dome, a sphere, a hemisphere, or any other geometric or other regular or irregular shape extending to the rear, namely away from the switch-facing end, from the joinder of neck 2 and canister 8.

Figure 8:
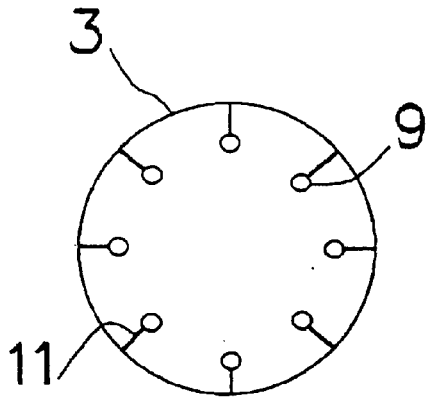
FIG. 8 illustrates an end elevation view of a flange used on an actuator housing wherein slits are shown extending between flange apertures and the outer surface of the flange.

As exemplary, and non-limiting display items, there can be mentioned, for example, ribbons, crocheted elements or articles, notes, photos, strings, ribbons, and the like. While flange 3 is shown as a continuous circle, the flange can, as indicated above, have any of a wide variety of configurations. FIG. 8, for example, shows a slit 11 between each aperture 9 in the flange and the outer edge of the flange. As example of further structural adaptation of even such disc-shaped flange, width of slits 11 can be expanded such that each piece of material between the respective apertures more represents a stand-alone flange element. Flange 3 can be discontinuous about the circumference of the canister. Flange 3 can be fabricated as, or replaced by, a mechanical gripper, a spring clip, or other item-holding structure, or such item-holding structure can be mounted ov the flange. Such display items as may be attached to flange 3, and/or flange 3 itself as indicated above can have functional features as well as in combination display and/or artistic features.

Flange 3 can be made of any of a wide variety of materials. While flange 3 can be made from relatively more rigid materials, the same material as is used for canister 8 can well be used for flange 3. Where slits 11 or other mounting feature is used which relies on resilience of the material of flange 3, such functional feature is considered in selecting the material from which flange 3 is fabricated.

Flange 3 is optional, and is not a critical feature of the invention, though flange 3 is highly useful in adding increased value to the invention. Where flange 3 extends to the rear of canister 8, away from the switch-facing end, flange 3 more represents a three dimensional object than a conventional flange.

Neck 2 extends downwardly from canister 8 adjacent flange 3, namely at or adjacent the user-facing end of canister 8. Neck 2 is typically integral with canister 8. Neck 2 typically does not extend from flange 3, but such extension from flange 3 is contemplated as part of the invention.

Referring to e.g. FIG. 1, shoulder 6 extends downwardly from neck 2 at an expanded width "W4". While the relationship between neck 2 and shoulder 6 is shown as one of width difference, the critical functional relationship which is served by such width differential is a differential in bending resistance. While shoulder 6 should be relatively less flexible in order to properly interface with arm 4, neck 2 should be relatively more flexible in order to flex with the arcuate movement of the switch toggle as the arm is lifted or lowered in moving the toggle/switch from an electrically actuated condition to an electrically isolated condition.

As suggested by the drawings, shoulder 6 serves as the interface between housing 14 and arm 4. While a variety of structures and methods can be used to mount shoulder 6 to arm 4, a preferred method of attachment is to mold shoulder 6 around arm 4.

Figure 7:
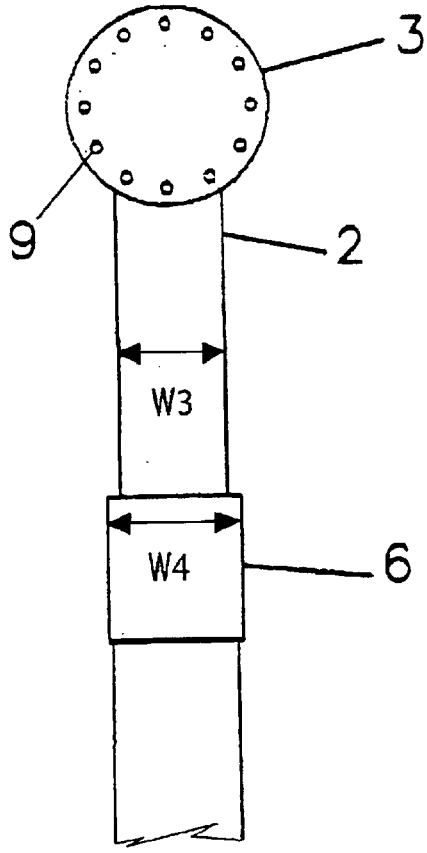
FIG. 7 shows an enlarged elevation view of an upper portion of a switch actuator housing as illustrated in FIG. 1.

Referring to FIGS. 6 and 7, the width "W3" of neck 2 is preferably less than the width "W2" between left and right sides of canister 8. Restated, the width "W2" of canister 8 is greater than the width "W3" of neck 2.

Still referring to FIG. 1, arm 4 is generally represented as a rigid elongate member. As depicted, arm 4 has a relatively wider portion 1 having a width "W'" and a relatively narrower portion having a width "W", and an overall length "L" including the length of shoulder 6. As illustrated in FIG. 3.1, arm 4 has a generally constant general thickness T.

Figure 4:
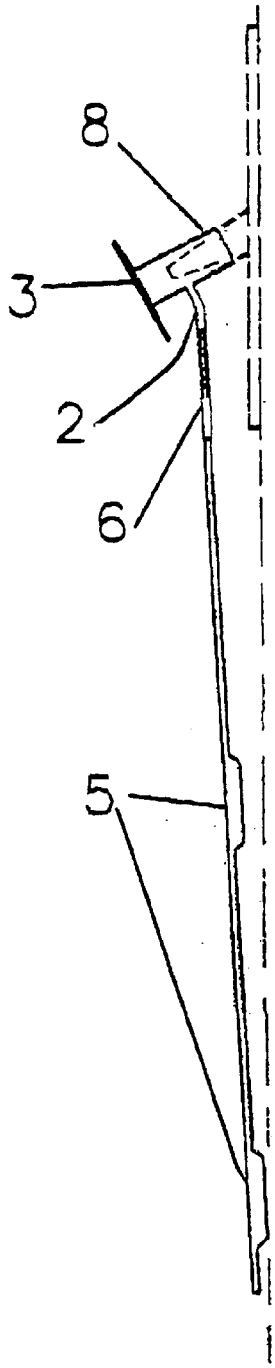
FIG. 4 shows a side view of the switch actuator of FIG. 1, mounted to a switch.

As seen in FIGS. 1, 3 and 4, arm 4 can have bumps, otherwise described as generally rigid protrusions 5. The generally rigid protrusions 5 improve the ability of a user to effectively grip the generally rigid elongate arm 4, as well as enhancing the overall rigidity of the arm. In addition, as seen in FIG. 4, the generally rigid protrusions 5 can minimize the portion of the surface area of arm 4 which can contact a wall when the actuator is mounted to a switch. Minimizing the amount of contact between arm 4 and a wall can first, reduce the amount of corresponding friction between the arm and the wall, thereby aiding in ease and effectiveness of use; second, enhance certainty of controlling staining or scratching on the wall, related to use of the invention. While arm 4 is shown as a generally elongate element, arm 4 can be specified in a wide variety of shapes, sizes, or configurations. The primary functions of arm 4 is to extend a sufficient distance from canister 8 to be reachable by a user, and to transfer actuating force of the user to housing 14. So long as arm 4 performs these functions, and satisfies other conditions recited herein, other features are merely optional.

Arm 4 can be made of the same material as housing 14. Alternatively, and preferably, arm 4 can be made of a more rigid material than housing 14. The material of arm 4 should be sufficiently lightweight that the weight of arm 4 does not pull a toggle switch to a downward oriented position by gravitational force. Also, the material of arm 4 should be sufficiently rigid to effectively transfer especially an upwardly-directed pushing force from a user, through neck 2 to canister 8, in order to influence a toggle switch from an electrically open circuit position to an electrically closed circuit position, or vise versa.

Those skilled in the art are well aware of materials, which posses such desirable qualities, and appropriate methods of forming such materials. Some suitable materials are various polymeric compounds, such as for example and without limitation, various of the polyolefins, such as a variety of the polyethylenes e.g. high density polyethylene, or polypropylenes. There can also be mentioned such commodity polymers as polyvinyl chloride and chlorinated polyvinyl chloride. A wide variety of other materials can also be used, as desired. For any polymeric or rubber material employed in structures of the invention, any conventional additive package can be included such as, for example and without limitation, slip agents, anti-block agents, release agents, anti-oxidants, and plasticizer, to control e.g. processing of the material as well as the properties of the finished processed product, of hardness, bending resistance, and the like.

Common industry methods of forming such polymeric compounds will suffice to make arm 4. Exemplary, but not limiting, of such processes is the commonly-known injection molding process.

Actuator 10 is preferably manufactured as 2 components, namely housing 14 and arm 4. Preferably arm 4 is molded first, and then housing 14 is molded with the interface portion of shoulder 6 molded about an end of arm 4.

In the alternative, housing 14 and arm 4 can be separately fabricated, and then attached to each other by other means. There can be mentioned, for example and without limitation, a wide variety of known attachment technologies such as chemical technologies, thermal technologies and/or mechanical technologies. Common industry methods of attaching such materials, such as by using polymer adhesives, thermal bonding, and/or a mechanical-friction fit will suffice to join the housing and arm to each other.

As suggested above, housing 14, including canister 8, neck 2, shoulder 6, and when used, outer flange 3 are preferably fabricated using a generally flexible material. The material should be able to sufficiently deform, and thereby to conform, around a corresponding toggle switch, such as a wall switch. However, the generally flexible material should also be sufficiently resilient, and should exhibit sufficient surface friction, to provide a friction grip between housing 14 and a corresponding switch toggle, as well as providing reasonable durability to sustain repeated use.

Housing 14 is sufficiently resilient to effectively transfer force from shoulder 6 through neck 2, through the more solid user-facing end of the canister, to the switch toggle. The force transfer property is desirable in light of the operational mechanism of a toggle switch. Restated, a toggle switch has a toggle, or lever, which is pivotally attached to a switching mechanism which requires application of a minimum threshhold force. The toggle pivots about a locus of pivotation while moving from an electrically open circuit position to an electrically closed circuit position, or vise versa. Therefore, the toggle travels in an arcuate path. However, arm 4 is designed to generally transfer force along a straight line path.

Returning to FIG. 1, reduced cross-section neck 2 extends downwardly from canister 8 to the less flexible, greater cross-section shoulder 6. As seen in FIG. 7, reduced cross-section neck 2 has a width W3. Shoulder 6 has a corresponding width W4. As seen in FIG. 6, canister 8 has a width W2 between left and right sides thereof. As seen in FIG. 7, magnitude of width W4 of shoulder 6 is greater than the magnitude of width W3 of neck 2. The magnitude of width W2 of the canister is also greater than width W3 of neck 2.

Neck 2 and shoulder 6 are preferably made from the same material as canister 8 and flange 3 whereby canister 8, neck 2, shoulder 6, and flange 3 can be fabricated as a unitary object in a single fabrication process.

The flexing characteristics of flexible neck 2 can be effective to transfer a linear force, applied at arm 4, into an arcuate movement at housing 14. Namely, a force can be applied in a substantially straight-line direction through arm 4, and can be translated through neck 2 to an arcuate motion at canister 8, thence to the switch toggle, whereby the flexing characteristics of neck 2 facilitate up-lifting of the toggle while exhibiting sufficient body, and related resistance to flexing, to effect the pushing up-lift of the toggle, thereby to operate the switch.

A variety of flexible materials, e.g. polymers and rubbers, can be mentioned as suitable for use in especially neck 2, and also in canister 8. Preferably canister 8 neck 2, shoulder 6, and flange 3 where used, are molded of a single material. Typically additive packages and plasticizers can be employed as needed.

In the alternative, the any one or more of these individual elements of the switch actuator can be separately fabricated and joined to any others of the elements according to the disclosed structure. Any commonly known method of forming such material or materials can be used. Where the housing is fabricated as a unitary structure, a molding process is preferred.

As suggested by the discussion above, and by the drawings, certain portions of housing 14 must be relatively more resiliently flexible, and others should be relatively less resiliently flexible. For example, substantial resilient flexibility and gripping friction are required of inner surfaces of canister 8 at opening 7. Namely, the side walls of the canister must flex in order to accommodate deformation of the canister side walls as the canister is pushed over a switch toggle.

The material of the canister must also be sufficiently resilient to retract about, and conform to, the switch toggle. Such material must also embrace sufficient surface friction, between the toggle and the inner surface of the canister at dead end bore opening 7, that the canister grips the toggle with sufficient retention force to ensure that the canister remains engaged with the toggle through repeated uses until/if the user wishes to disengage the canister from the toggle.

Similarly, neck 2 must have a degree of flexibility sufficient to transform straight line motion of handle 4 into arcuate motion of the toggle. At the same time, neck 2 must be sufficiently resistant to bending, flexing to ensure that an upwardly-directed force on handle 4 is transferred to the switch toggle without the neck resistance to such up-lifting force being overcome by the magnitude of the up-lifting force so as to excessively flex the neck, e.g. to a 90 degree bend, such that the neck does not effectively transmit the up-lifting force to the canister and toggle.

Where a unitary structure is fabricated for the actuator, a molding process is preferred.

The relative flexibility of the respective elements of actuator 10 can be achieved by material selection and/or by specifying cross-section of the material in a given location of interest. For example, given a base-line resistance to bending, a portion of housing 14 can be made more flexible either by fabricating the element from a different material and at a corresponding, e.g. the same, cross-section, or by fabricating the element from the same material but from a lesser cross-section or a more bendable cross-sectional configuration.

By corollary, an element can be made less flexible, and thus more resistant to flexing, by fabricating the element from the same material but from a greater cross-section or a cross-section otherwise more resistant to flexing; or by fabricating the element from a different material at an appropriate, e.g. the same, cross-section. There are, of course, a wide variety of cross-sections and materials selections from which one might choose in order to achieve the desired bending/flexing properties.

As in FIG. 7, outer flange 3 preferably has at least one aperture 9, more preferably multiple apertures, formed therethrough. An aperture 9, or a plurality of apertures 9 can enable a user to modify the extension control device as the user sees fit, e.g. by using apertures as auxiliary fastening structures. For example, a user can choose to affix some form of ornamentation to the extension control device by attachment through apertures 9. For example, a piece of ornamentation can be affixed to the outer flange 3 by feeding a piece of string or wirethrough the aperture, then tying the string or wire to the piece of ornamentation. As a further example, a simple mechanical clip can be attached to an aperture 9, or to the body of flange 3 to hold a piece of ornamentation or other display item.

Alternatively, a user can choose to affix documents, such as personal reminder notes to the actuator 10 via the apertures 9. This enables a user to be reminded of the substance of the note whenever the switch actuator is used. Those skilled in the art will know how to form apertures 9 through outer flange 3. A wide variety of commonly used punching and/or drilling techniques suffice to form apertures 9 through outer flange 3.

Figure 2:
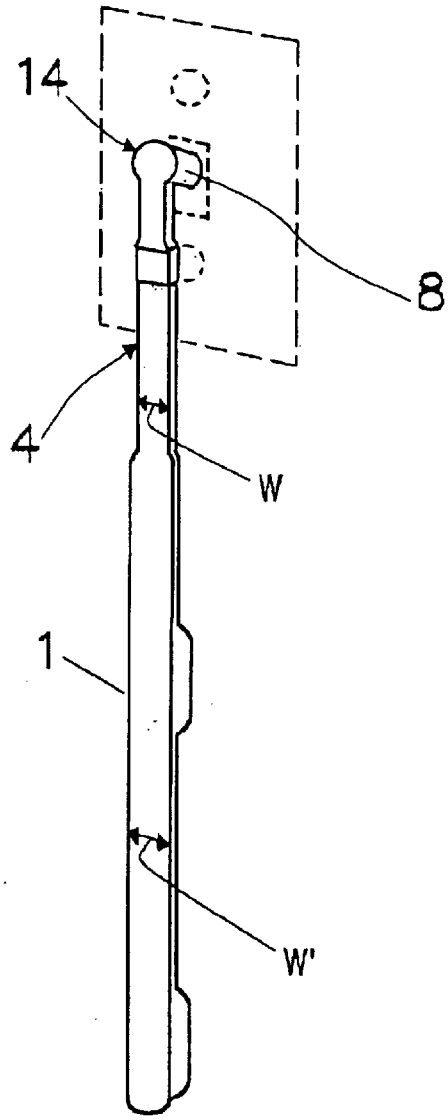
FIG. 2 shows a perspective view of a second embodiment of switch actuators of the invention, mounted to a switch.

A second embodiment of the invention, which is devoid of flange 3, is shown in FIGS. 2,3 and 3.1.

FIG. 4 shows the embodiment of FIG. 1 in side elevation, mounted over a switch toggle.

Figure 5:
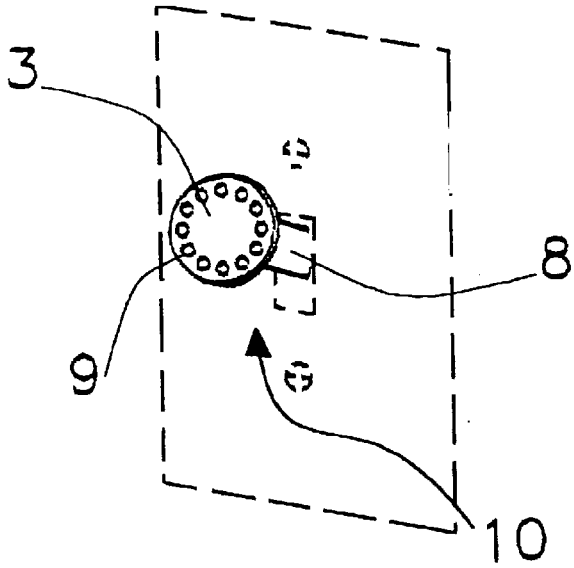
FIG. 5 shows a perspective view of a third embodiment of switch actuators of the invention, mounted to a switch.

FIGS. 5 and 6 generally illustrate a switch actuator 10 which incorporates flange 3 and is devoid of arm 4. Accordingly, actuator 10 is also devoid of neck 2 and shoulder 6.

In all of the abovementioned embodiments, the invention relates to transferring a force applied by a user, through the switch actuator, as to apply such force to a toggle switch. Thus, a user has physical contact with the switch actuator so as to manipulate the switch through the switch actuator. Accordingly, in some embodiments the switch actuator is impregnated with releasable antibacterial material to kill germs, bacterium, and the like as the antibacterial material is gradually releaed over time from arm 4. Such extension control features, which are especially likely to be subject to user contact include the outer flange 3, and/or elongate arm 4.

An impregnated antibacterial material may be particularly desirable when the extension control device user is a child, whose immune system may not be fully developed. Those skilled in the art will know conventional ways to obtain and employ such antibacterial properties. Among the methods commonly know is the use of Microban® polymer additive, incorporated into the material of the arm or housing as the arm or housing is being fabricated.

Figure 9:
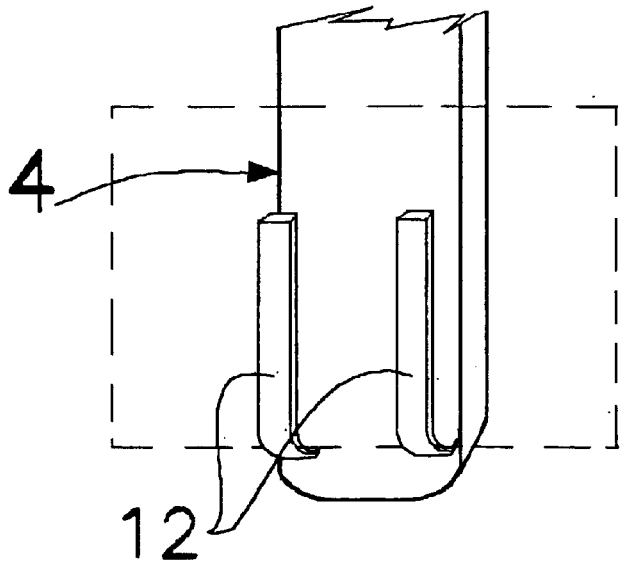
FIG. 9 shows a lower portion of the actuator arm holding an imaginary note or photo.

FIG. 9 shows an additional embodiment of arm 4, modified to include a pair of fingers 12 extending outwardly and upwardly from a lower portion of the arm, and configured to hold a card, photo, note, or the like as another example of a display item. Structure to hold such display items can, of course, be represented by a wide variety of structural designs, all of which are intended to be within the scope of the invention.

As used herein, and in the claims which follow, recitation of neck 2 as being connected to arm 4 includes such connection being optionally effected through shoulder 6, whereby such recitation includes both embodiments which use an expanded width, expanded cross-section shoulder for direct attachment to arm 4, and embodiments wherein neck 2 is directly attached to arm 4 without use of a shoulder 6.

Those skilled in the art will now see that certain modifications can be made to the apparatus and methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

What is claimed is:

1. A switch actuator adapted to receive a switch, said switch actuator comprising:

(a) a generally flexible actuator housing having a longitudinal axis, said generally flexible actuator housing comprising (i) a canister having an outer surface, a left side and a right side, and a width W2 between the left and right sides, said canister further comprising a resiliently flexible switch-facing end and a generally closed user-facing end, said generally flexible switch-facing end having an opening adapted to resiliently receive and grip a such switch, and (ii) a generally flexible neck extending from said canister, said generally flexible neck having a width W3, magnitude of the width W2 of said canister being greater than magnitude of the width W3 of said generally flexible neck; and (b) as a distinct element, a generally rigid elongate arm extending from said generally flexible neck.

2. A switch actuator as in claim 1, further comprising a shoulder extending from said neck, said shoulder being located proximate said generally rigid elongate arm, said shoulder having a width W4, the magnitude of each of said width W4 and said width W2 being greater than the magnitude of said width W3.

3. A switch actuator as in claim 1 wherein said generally rigid elongate arm has a first distal end and a second distal end, and a length "L" therebetween, further comprising a shoulder extending from said neck, said neck having a relatively smaller cross-section than said shoulder, over half of an area defined by a length and a width of said shoulder communicating with one of said first and second distal ends of said generally rigid elongate arm.

4. A switch actuator as in claim 1 wherein said generally rigid elongate arm comprises a front surface and a back surface, defining a thickness "T" therebetween, and firs and second side edges having a width "W" therebetween, magnitude of width "W" being greater than magnitude of thickness "T".

5. A switch actuator as in claim 1 wherein, when said neck is free from stresses which deflect said neck from a rest condition, said generally flexible neck is generally coplanar with said generally rigid elongate arm.

6. A switch actuator as in claim 1 wherein at least one of said generally rigid elongate arm and said canister further comprises mounting structure adapted to receive a display item.

7. A switch actuator as in claim 1 wherein at least one of said generally rigid elongate arm and said canister is releasably impregnated with antibacterial material.

8. A switch actuator adapted to receive a switch, said switch actuator comprising:

(a) an actuator housing having a longitudinal axis, said generally flexible actuator housing comprising (i) a canister having an outer surface, a left side and a right side, and a width W2 between the left and right sides, said canister further comprising a resiliently flexible switch-facing end and a user-facing end, said resiliently flexible switch-facing end having an opening adapted to thereby resiliently receive and grip a such switch, (ii) a neck extending from said canister, said neck having a width W3, magnitude of the width W2 of said canister being greater than magnitude of the width W3 of said neck, and (iii) a flange extending outwardly from the outer surface of said canister and extending away from the longitudinal axis, said flange being displaced from the switch-facing end of said canister; and (b) a generally rigid elongate arm extending from said neck.

9. A switch actuator as in claim 8, further comprising a shoulder extending from said neck, said shoulder being located proximate said generally rigid elongate arm, said shoulder having a width W4, the magnitude of each of said width W4 and said width W2 being greater than the magnitude of said width W3.

10. A switch actuator as in claim 8 wherein said generally rigid elongate arm has a first distal end and a second distal end, and a length "L" therebetween, said neck, when said actuator is mounted on a such switch, having a relatively smaller cross-section top portion, and a relatively larger cross-section bottom portion, substantially all of said bottom portion of said neck communicating with one of said first and second distal ends of said generally rigid elongate arm.

11. A switch actuator as in claim 8 wherein said generally rigid elongate arm comprises front and back surfaces, and a thickness "T" therebetween, and first and second side edges having a width "W" therebetween, magnitude of width "W" being greater than magnitude of thickness "T".

12. A switch actuator as in claim 8 wherein, when said neck is free from stresses which would deflect said neck from a rest condition, said generally flexible neck is generally coplanar with said generally rigid elongate arm.

13. A switch actuator as in claim 8 wherein at least one of said generally rigid elongate arm and said canister further comprises mounting structure adapted to receive a display item.

14. A switch actuator as in claim 8 wherein at least one of said generally rigid elongate arm and said canister is releasably impregnated with antibacterial material.

15. A switch actuator as in claim 8 wherein said flange comprises at least one aperture extending therethrough.

16. A switch actuator as in claim 8 wherein said flange extends generally outwardly from said generally closed user-facing end of said canister, away from said switch-facing end.

17. A switch actuator adapted to receive a switch, said switch actuator comprising:

(a) a canister having an outer side surface, said canister further comprising a resiliently flexible switch-facing end and a user-facing end, said resiliently flexible switch-facing end having an opening adapted to resiliently receive and grip a such switch, and (b) a flange extending outwardly beyond the outer side surface of said canister and extending away from the longitudinal axis, said flange being displaced from the switch-facing end of said canister.

18. A switch actuator as in claim 17, said flange having at least one aperture extending therethrough.

19. A switch actuator as in claim 18, said flange having an outer perimeter, said at least one aperture being generally adjacent said outer perimeter of said outer flange and optionally extending generally parallel to the longitudinal axis.

20. A switch actuator as in claim 17 wherein said canister further comprises mounting structure adapted to receive a display item.

21. A switch actuator as in claim 17 wherein said canister is releasably impregnated with antibacterial material.

22. A switch actuator as in claim 17 wherein said flange extends generally outwardly from said generally closed user-facing end of said canister, away from a such switch.

23. A switch actuator adapted to receive a switch, said switch actuator comprising:

(a) a generally flexible actuator housing having a longitudinal axis, said generally flexible actuator housing comprising (i) a canister having a resiliently flexible switch-facing end and a user-facing end, said resiliently flexible switch-facing end having an opening adapted to resiliently receive and grip a such switch, and (ii) a generally flexible neck extending, when said neck is free from stresses which would tend to deflect said neck from a rest condition, from said canister at an angle of about 45 degrees to about 150 degrees with respect to the longitudinal axis; and (b) a generally rigid elongate arm extending from said generally flexible neck.

24. A switch actuator as in claim 23 wherein said canister has a width "W2" and said generally flexible neck has a width "W3", said actuator housing further comprising a shoulder extending from said neck, said shoulder being located proximate said generally rigid elongate arm, said shoulder having a width "W4", the magnitude of each of said width "W4" and said width "W2" being greater than the magnitude of said width "W3".

25. A switch actuator as in claim 23 wherein said generally rigid elongate arm has a first distal end and a second distal end, and a length "L" therebetween, further comprising a shoulder extending from said neck, said neck having a relatively smaller cross-section than said shoulder, over half of an area defined by a length and a width of said shoulder communicating with one of said first and second distal ends of said generally rigid elongate arm.

26. A switch actuator as in claim 23 wherein said generally rigid elongate arm comprises a front surface and a back surface, defining a thickness "T" therebetween, and firs and second side edges having a width "W" therebetween, magnitude of width "W" being greater than magnitude of thickness "T".

27. A switch actuator as in claim 23 wherein, when said neck is free from stresses which deflect said neck from a rest condition, said generally flexible neck is generally coplanar with said generally rigid elongate arm.

28. A switch actuator as in claim 23 wherein at least one of said generally rigid elongate arm and said canister further comprises mounting structure adapted to receive a display item.

29. A switch actuator as in claim 23 wherein at least one of said generally rigid elongate arm and said canister is releasably impregnated with antibacterial material.

* * * * *

UNITED STATES PATENT AND TRADEMARK OFFICE

CERTIFICATE OF CORRECTION

PATENT NO. : 6,822,177 B1
DATED : November 23, 2004
INVENTOR(S) : Grant W. LaPlante It is certified that error appears in the above-identified patent and that said Letters Patent is hereby corrected as shown below:

Column 4,
Line 3, delete "FIG. 6 shows is a top view" and insert -- FIG. 6 shows a top view -- in place thereof.

Column 5,
Line 49, delete "ov" and insert -- on -- in place thereof.

Column 9,
Line 14, delete "wirethrough" and insert -- wire through -- in place thereof.

Column 10,
Line 49, delete "firs" and insert -- first -- in place thereof.

Column 12,
Line 51, delete "firs" and insert -- first -- in place thereof.

Signed and Sealed this

Tenth Day of May, 2005

JON W. DUDAS
*Director of the United States Patent and Trademark Office*